US011206893B2

(12) United States Patent
Winskowicz et al.

(10) Patent No.: US 11,206,893 B2
(45) Date of Patent: Dec. 28, 2021

(54) GOLF SHOE

(71) Applicant: SQAIRZ LLC, Windham, NH (US)

(72) Inventors: Robert Winskowicz, Windham, NH (US); Joseph Napurano, Natick, MA (US)

(73) Assignee: SQAIRZ LLC, Windham, NH (US)

( * ) Notice: Subject to any disclaimer, the term of this patent is extended or adjusted under 35 U.S.C. 154(b) by 118 days.

(21) Appl. No.: 16/681,913

(22) Filed: Nov. 13, 2019

(65) Prior Publication Data

US 2020/0315285 A1 Oct. 8, 2020

Related U.S. Application Data

(60) Provisional application No. 62/829,599, filed on Apr. 4, 2019.

(51) Int. Cl.
*A43B 5/00* (2006.01)
*A43B 3/00* (2006.01)
*A43C 15/16* (2006.01)

(52) U.S. Cl.
CPC ..... *A43B 5/001* (2013.01); *A43B 3/0042* (2013.01); *A43C 15/16* (2013.01)

(58) Field of Classification Search
CPC ..... A43B 5/001; A43B 3/0036; A43B 3/0042; A43B 23/088; A43C 15/16; A43C 15/162
USPC ..... 36/127, 134, 69
See application file for complete search history.

(56) References Cited

U.S. PATENT DOCUMENTS 2,503,586 A 2/1946 Miller
3,175,827 A 3/1965 Livingood
3,244,421 A 4/1966 Hanna
4,186,500 A 2/1980 Salzman
4,199,881 A 4/1980 Francis
4,246,708 A 1/1981 Gladek
4,407,079 A * 10/1983 Chiroff ..... A63B 69/3608 36/127
4,586,274 A * 5/1986 Blair ..... A43C 13/04 36/114
4,653,206 A * 3/1987 Tanel ..... A43C 13/04 36/126
4,660,304 A * 4/1987 Tanel ..... A43C 13/04 36/126
4,689,901 A * 9/1987 Ihlenburg ..... A43B 3/0042 36/114
4,843,735 A * 7/1989 Nakanishi ..... A43B 13/187 36/28

(Continued)

FOREIGN PATENT DOCUMENTS

DE 202006015135 U1 3/2007
KR 1020050120086 A 12/2005

OTHER PUBLICATIONS

British Office Report, for corresponding application GB2005059.7; Report dated Oct. 7, 2020.

(Continued)

*Primary Examiner* — Marie D Bays
(74) *Attorney, Agent, or Firm* — Cantor Colburn LLP

(57) ABSTRACT

A shoe for golf including an upper, a midsole, and an outsole arranged to form an enclosure adapted to receive a foot of a wearer, and a toe area disposed at a front of the shoe and adapted to house toes of the wearer, where the toe area has an oblique shape delimited by an outer radius of the outsole of greater than zero.

13 Claims, 14 Drawing Sheets

(56) References Cited

U.S. PATENT DOCUMENTS

| | | | | |
|---|---|---|---|---|
| 4,937,954 | A * | 7/1990 | Clement | A43B 3/0094 36/127 |
| 5,265,354 | A * | 11/1993 | Aliano, Jr. | A43B 5/001 36/127 |
| 5,301,442 | A | 4/1994 | Williams | |
| 5,381,614 | A * | 1/1995 | Goldstein | A43B 3/0094 36/1 |
| D400,346 | S | 11/1998 | Singer | |
| D406,938 | S | 3/1999 | Lin | |
| D412,392 | S | 8/1999 | Singer | |
| D416,670 | S | 11/1999 | Singer | |
| 6,457,976 | B1 | 10/2002 | Fleshman | |
| D483,175 | S | 12/2003 | Robinson | |
| D507,400 | S | 7/2005 | Robinson | |
| 6,912,802 | B2 | 7/2005 | Cooper | |
| D509,948 | S | 9/2005 | Robinson | |
| D525,768 | S | 8/2006 | Robinson | |
| D527,876 | S | 9/2006 | Robinson | |
| D527,877 | S | 9/2006 | Robinson | |
| D540,012 | S | 4/2007 | Robinson | |
| 7,228,649 | B2 | 6/2007 | Elliott | |
| D552,336 | S | 10/2007 | Parekh | |
| D561,444 | S | 2/2008 | Feeney | |
| 7,412,784 | B1 * | 8/2008 | Bobbett | A43C 15/161 36/134 |
| D581,146 | S | 11/2008 | Lane | |
| D586,989 | S | 2/2009 | Dave | |
| D587,441 | S | 3/2009 | Lane | |
| D587,442 | S | 3/2009 | Robinson | |
| D593,736 | S | 6/2009 | Mochen | |
| D593,737 | S | 6/2009 | Mochen | |
| D601,785 | S | 10/2009 | Lane | |
| D608,081 | S | 1/2010 | Bacon | |
| D612,137 | S | 3/2010 | Duan | |
| D618,895 | S | 7/2010 | Wolff | |
| 8,051,583 | B2 | 11/2011 | Roether | |
| D685,983 | S | 7/2013 | Winskowicz | |
| D691,679 | S | 10/2013 | Barrett | |
| 8,663,025 | B2 | 3/2014 | Barrett | |
| 8,721,468 | B1 | 5/2014 | Barrett | |
| D706,679 | S | 6/2014 | Hilderbrand | |
| D707,432 | S | 6/2014 | Mochen | |
| D707,929 | S | 7/2014 | Feeney | |
| D709,273 | S | 7/2014 | Winskowicz | |
| D709,679 | S | 7/2014 | Winskowics | |
| D728,205 | S | 5/2015 | Weddle | |
| D735,975 | S | 8/2015 | Lane | |
| D752,326 | S | 3/2016 | Bacon | |
| D756,617 | S | 5/2016 | Weddle | |
| D759,361 | S | 6/2016 | Robinson | |
| D766,558 | S | 9/2016 | Weddle | |
| D793,686 | S | 8/2017 | Bacon | |
| D802,267 | S | 11/2017 | Bacon | |
| D825,905 | S | 8/2018 | Bacon | |
| D852,487 | S | 7/2019 | Greenhalgh | |
| D856,638 | S | 8/2019 | Bacon | |
| D871,740 | S | 1/2020 | Weddle | |
| D886,431 | S | 6/2020 | Dean | |
| D887,116 | S | 6/2020 | Ringholz | |
| D893,849 | S | 8/2020 | Bidal | |
| 2002/0043008 | A1 * | 4/2002 | Favreau | A43C 15/161 36/134 |
| 2002/0178618 | A1 * | 12/2002 | Pitts | A43B 5/001 36/127 |
| 2004/0159019 | A1 | 8/2004 | Cooper | |
| 2006/0040757 | A1 | 2/2006 | Rosselli | |
| 2006/0242863 | A1 | 11/2006 | Patmore | |
| 2008/0155843 | A1 | 7/2008 | Yun | |
| 2009/0013516 | A1 | 1/2009 | Robinson | |
| 2009/0113757 | A1 * | 5/2009 | Banik | A43B 13/26 36/28 |
| 2011/0185592 | A1 * | 8/2011 | Nishiwaki | A43B 7/16 36/69 |
| 2011/0288446 | A1 * | 11/2011 | Hsieh | A61B 5/1036 600/592 |
| 2013/0210536 | A1 * | 8/2013 | Winskowicz | A63B 69/3608 473/217 |
| 2013/0333247 | A1 * | 12/2013 | Grott | A43C 9/00 36/127 |
| 2014/0013625 | A1 | 1/2014 | Grott | |
| 2014/0123522 | A1 | 5/2014 | Rustam | |
| 2016/0366975 | A1 * | 12/2016 | Toschi | A43B 5/001 |
| 2018/0000191 | A1 * | 1/2018 | Bacon | A43B 5/001 |
| 2020/0046072 | A1 | 2/2020 | Bento | |
| 2020/0315285 | A1 | 10/2020 | Winskowicz | |

OTHER PUBLICATIONS

Arrow—White with Red, Sqairz.com, [online], [site visited Jan. 13, 2021],. <URL:http://sqairz.com/sqairz-arrow-whitered/> (year: 2021).

Soccer Meets the Links with the Adidas Samba Golf Shoe, Admuku.com, Posted on May 12, 2021 by Admuku.com Staff, [online], [site visited Jan. 13, 2021], <URL: https://www.abmuku.com/2012/05/12/gear/adidias-samba-golf-shoe-review-pictures/> (year: 2012).

Sqairz Golf Shoes—The New Shape of Innovation?, MyGolfSpy.com, by John Barba, Jun. 16, 2020 [online], [site visited Jan. 13, 2021], <URL:https://mygolfspy.com/sqairz-golf-shoes-the-new-shape-of-innovation/> (year: 2020).

Mike Stachura, "Those aren't just three lines on Phil Mickelson's golf ball—They're science", Golf Digest, Feb. 20, 2019, p. 1-7, URL: https://www.golfdigest.com/story/those-aren't-just-three-lines-on-Phil-Mickelsons-golf-balltheyre-science/amp.

British Office Action for corresponding application GB2005059.7; Report dated Sep. 24, 2021.

* cited by examiner

GOLF SHOE

CROSS REFERENCE TO RELATED APPLICATION

This application is related to and claims the benefit of U.S. Provisional Patent Application Ser. No. 62/829,599 filed on Apr. 4, 2019, the contents of which are incorporated herein by reference in their entirety.

TECHNICAL FIELD

This disclosure concerns athletic footwear and, more particularly, a shoe for golf which provides enhanced traction, stability, and comfort while encouraging proper alignment of the wearer relative to the golf ball and target as he or she prepares for the golf swing, and which allows a greater range of motion of the foot of the wearer while executing the golf swing.

BACKGROUND

The golf equipment and apparel industry is replete with examples of design improvements that intend to enhance performance on the golf course. This can be readily seen in golf clubs, golf balls, training aids, etc. However, rarely has golf footwear been linked to golf performance. More typically, innovation in golf footwear centers around comfort, weight reduction, cushioning, lacing systems, water resistivity, and fashion, all of which do not directly help the golfer to play the game better. This is a lost opportunity, considering that the feet are the body's only link to the ground during the golf swing and much of the power in a golf swing is generated from the interaction of the feet and ground. Moreover, the alignment of a golfer vis-à-vis the ball and target is established at the foot/ground interface. These important aspects of golf, and their link to performance, have largely been overlooked by the sports designers and engineers. To the contrary, current golf footwear designs tend to shift the big toe toward the center of the shoe, thus limiting the foot's range of motion and effecting overall body stability. Additionally, current golf footwear designs fail to address concentrated areas of pressure between the foot, shoe, and ground that are generated during the golf swing and none effectively assist a golfer with alignment when setting up to the ball and preparing for the golf swing.

BRIEF SUMMARY

A shoe for golf is provided herein including an upper, a midsole, and an outsole arranged to form an enclosure adapted to receive a foot of a wearer, and a toe area disposed at a front of the shoe and adapted to house toes of the wearer, where the toe area has an oblique shape delimited by an outer radius of the outsole of greater than zero.

In a further embodiment, a shoe for golf is herein provided as including an upper, a midsole, and an outsole arranged to form an enclosure adapted to receive a foot of a wearer, a toe area disposed at a front of the shoe and adapted to house toes of the wearer, where the toe area has an oblique shape delimited by an outer radius of the outsole of greater than zero, a heal stabilizer having a heel band extending around a heel portion of the shoe connected at a midfoot area to a midfoot shank which is fixed to at least one of the midsole and the outsole, where the heel stabilizer is configured to center the foot of the wearer within the shoe to provide stability to the foot, a plurality of cleats arranged on a bottom of the outsole at areas that are subject to the highest forces during use of the shoe, the plurality of cleats including a first cleat disposed in the toe area of the shoe and arranged to generally align with a big toe of the wearer, a second cleat disposed in a forefoot area of the shoe and arranged to generally align with a first ray of the foot of the wearer, a third cleat disposed at a medial side of a heel area of the shoe proximate to a rearward extent of the shoe, and a fourth cleat disposed on a lateral side of the heel portion, forward of the third cleat, and lugs generally arranged in concentric circles about each of the plurality of cleats.

Also provided herein is a golf shoe, including a plurality of cleats arranged on a bottom of the outsole at areas that are subject to the highest forces during use of the shoe, the plurality of cleats having a first cleat disposed in the toe area of the shoe and arranged to generally align with a big toe of the wearer, a second cleat disposed in a forefoot area of the shoe and arranged to generally align with a first ray of the foot of the wearer, a third cleat disposed at a medial side of a heel area of the shoe proximate to a rearward extent of the shoe, and a fourth cleat disposed on a lateral side of the heel portion, forward of the third cleat, and lugs generally arranged in concentric circles about each of the plurality of cleats, where each lug is shaped as an arcuate segment and extends along the respective concentric circle.

BRIEF DESCRIPTION OF THE DRAWINGS

For a more complete understanding of this disclosure, reference is now made to the following brief description, taken in connection with the accompanying drawings and detailed description, wherein like reference numerals represent like parts, in which.

DETAILED DESCRIPTION

Figure 1:
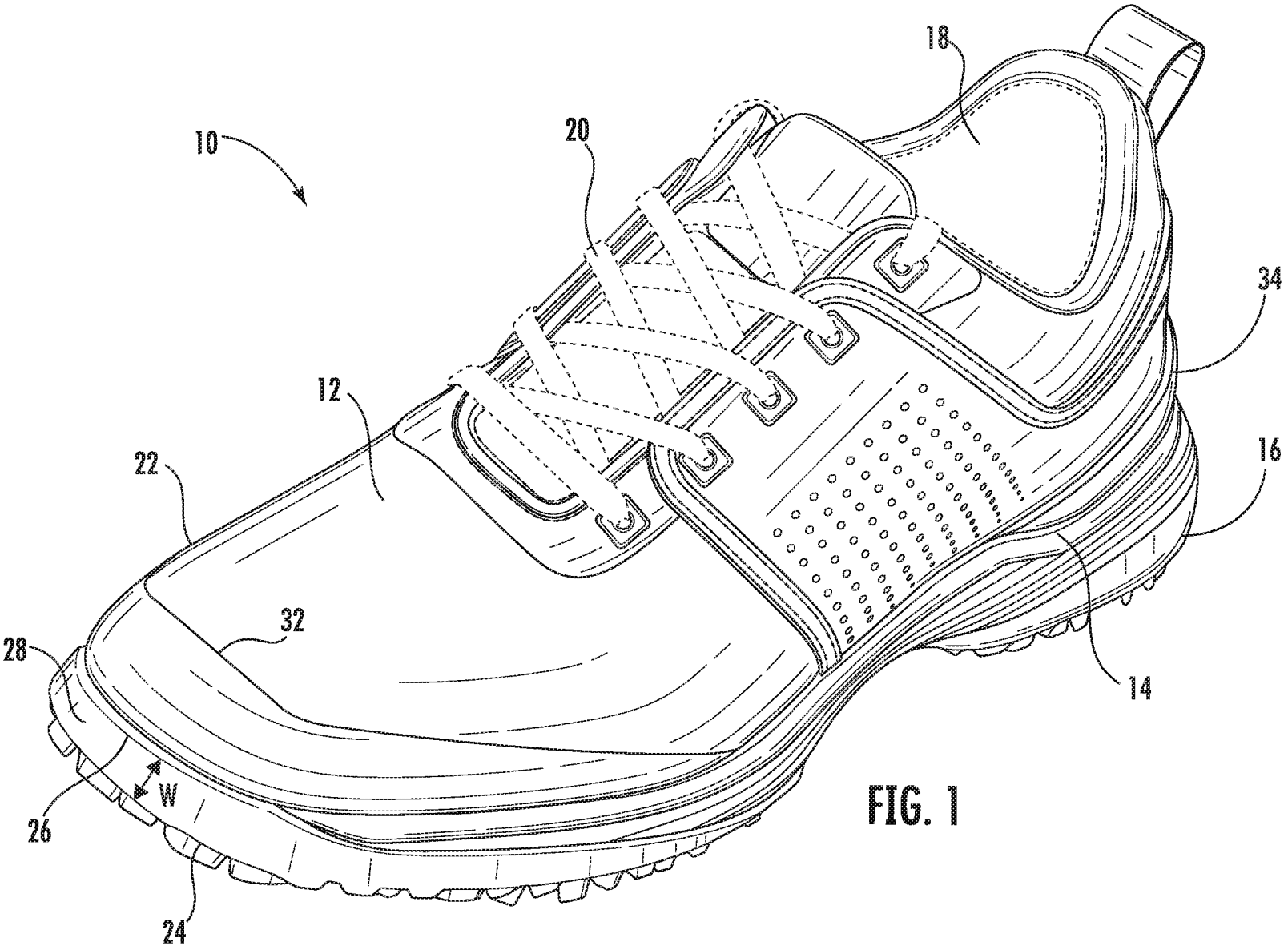
FIG. 1 is a perspective view of a shoe for golf according to one exemplary embodiment.
Figure 2:
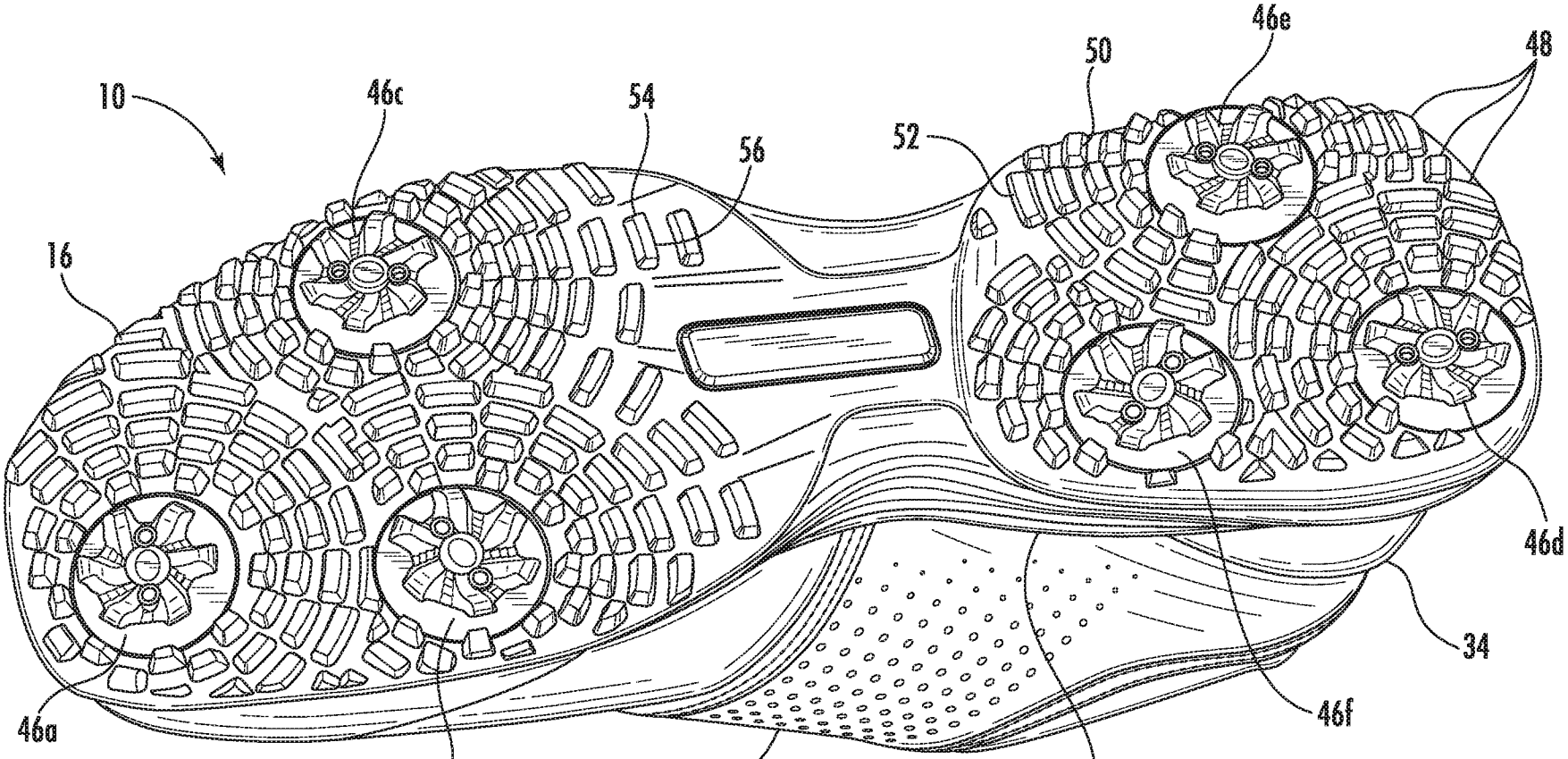
FIG. 2 is a bottom view thereof.

FIGS. 1-8 show a golf shoe 10 in one exemplary embodiment of the present disclosure. For sake of brevity, the shoe 10 is illustrated as being configured to fit a left foot of a wearer. The broad disclosure of course covers the shoe configured for a right foot, the various features and elements discussed herein being oppositely disposed therein. The shoe 10 includes an upper 12, a midsole 14, and an outsole 16. The upper 12 may be composed of synthetic or natural materials, or a combination thereof, and is secured to the midsole 14 via adhesive, welding, molding technique, or any other means sufficient to ensure that the upper 12 remains fixed to the midsole 14 during usage. Similarly, the midsole 14 is affixed to the outsole 16 by means sufficient to ensure a secure pairing therewith. In alternate embodiments, the upper 12 is secured directly to the outsole 16 and the midsole 14 is disposed at an interior of the upper and is there affixed to both the upper and the outsole. In a further alternate embodiment, the midsole 14 and the outsole 16 may be formed together as a single unit, with the upper disposed separately atop the one-piece midsole/outsole construction. Here, the outsole 16 may be molded onto, welded, adhered, or otherwise affixed to the unitary midsole/outsole configuration. The shoe 10 may further include an insole disposed within the upper 12 atop the midsole 14 in order to provide comfort to the wearer.

The upper 14 includes an opening 18, through which the foot of a wearer is inserted into the shoe 10, and a closure arrangement 20, such as a lacing system, in order to allow the wearer to secure the shoe 10 about the foot.

The upper 12, midsole 14, and outsole 16 are configured to give the shoe 10 an oblique shaped toe area 22. The outsole 16 includes an outermost perimeter that, in the toe area 22, delimits the forwardmost edge of the shoe 10. This edge, referred to herein as an outer radius 24, is not a straight line and instead has some degree of curvature. That is, the outer radius 24 has a length greater than 0 mm and is preferably between about 60 mm and about 80 mm. In one exemplary embodiment, the length of the outer radius 24 is about 70 mm, giving the front of the shoe 10 a somewhat flattened appearance. The outsole 16 as a second perimeter edge at the toe area 22 which is rearward and radially inward of the outer radius 24. This edge, referred to herein as an inner radius 26, is again not a straight line but instead has some degree of curvature. That is, a length of the inner radius 26 is greater than 0 mm and is preferably between about 55 mm and about 75 mm. In one exemplary embodiment, the inner radius 26 is about 66 mm. The outer and inner radii 24, 26 give the toe area 22 of the shoe 10 an oblique appearance but yet one that is slightly curved and not squared.

Figure 3:
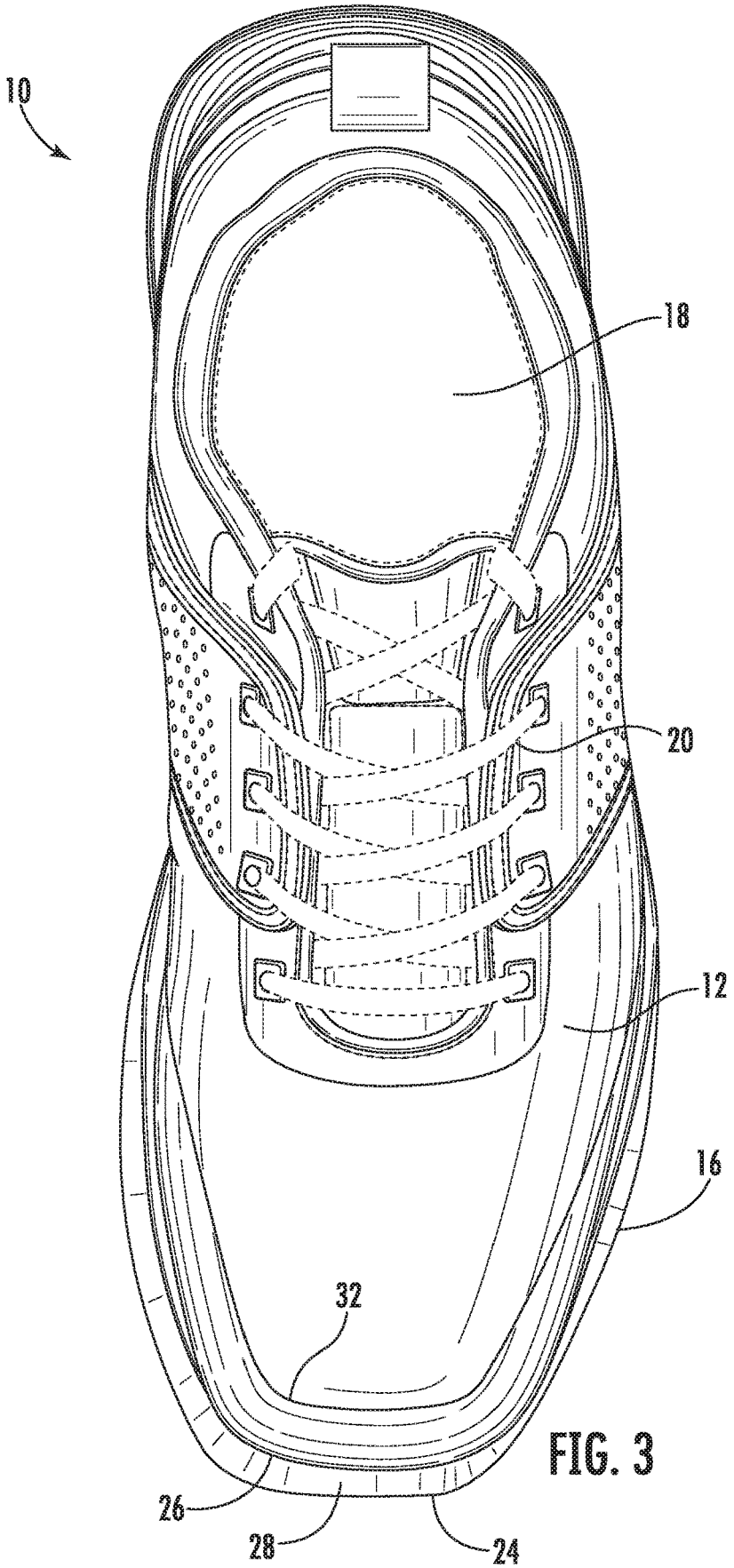
FIG. 3 is a top view thereof.
Figure 5:
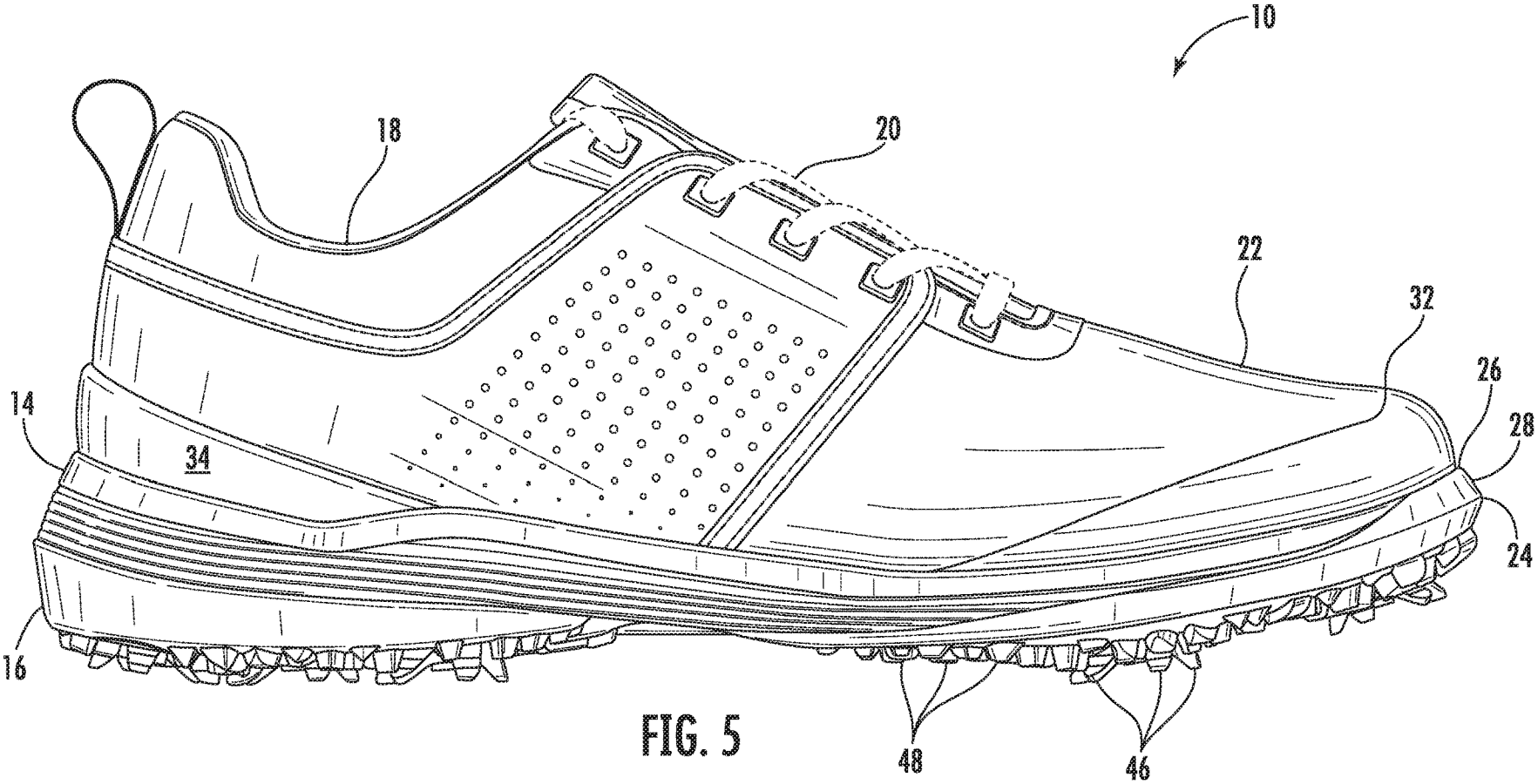
FIG. 5 is a side view thereof.
Figure 6:
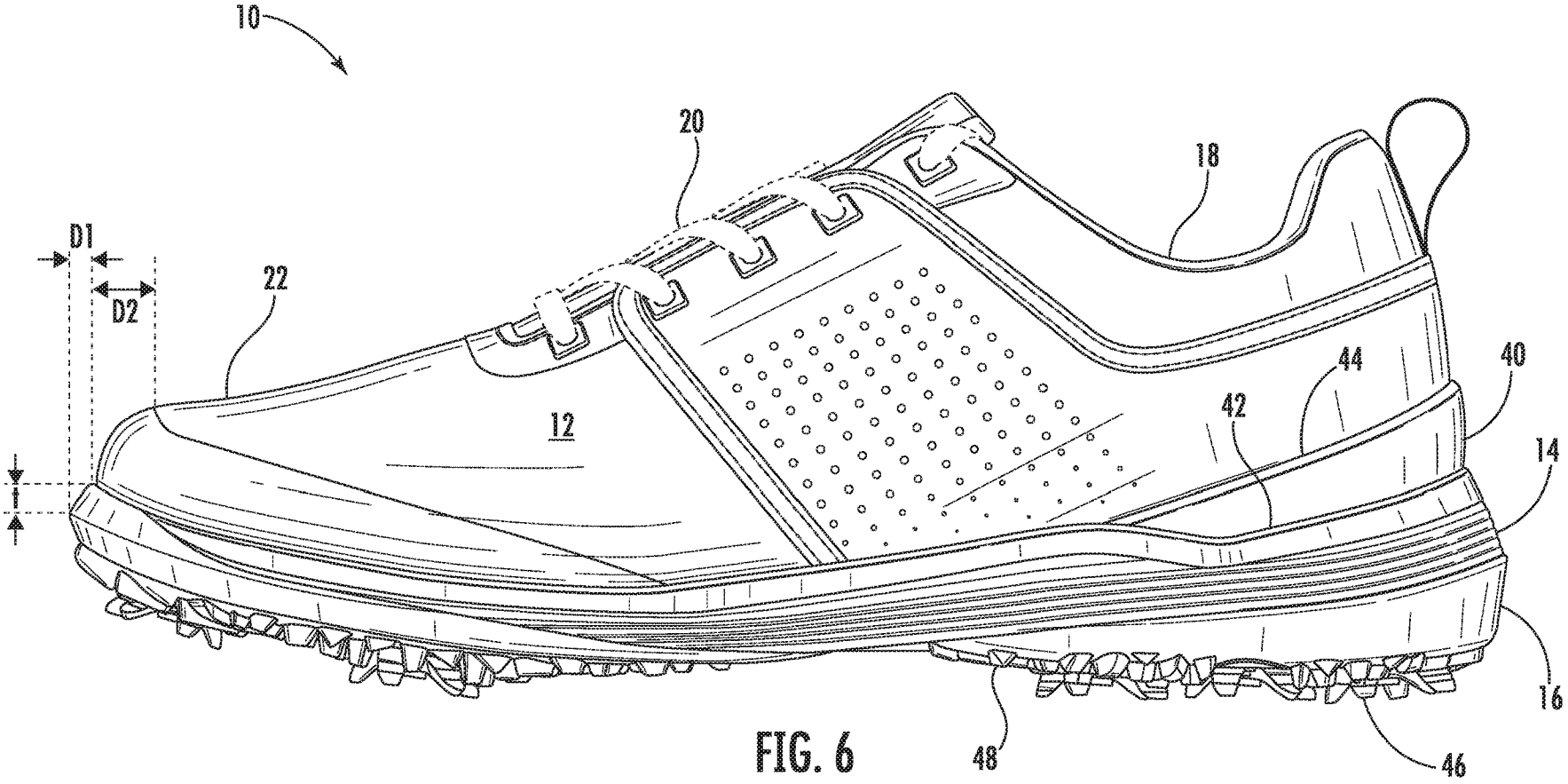
FIG. 6 is an opposite side view thereof.
Figure 7:
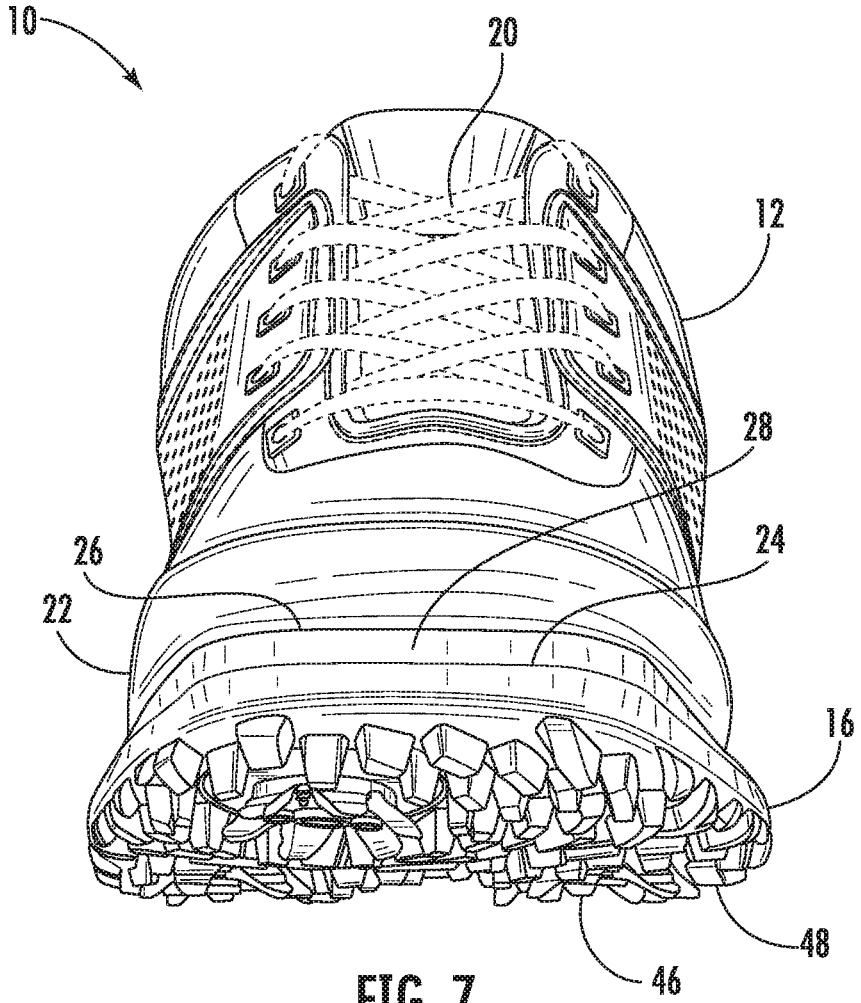
FIG. 7 is a front view thereof.
Figure 8:
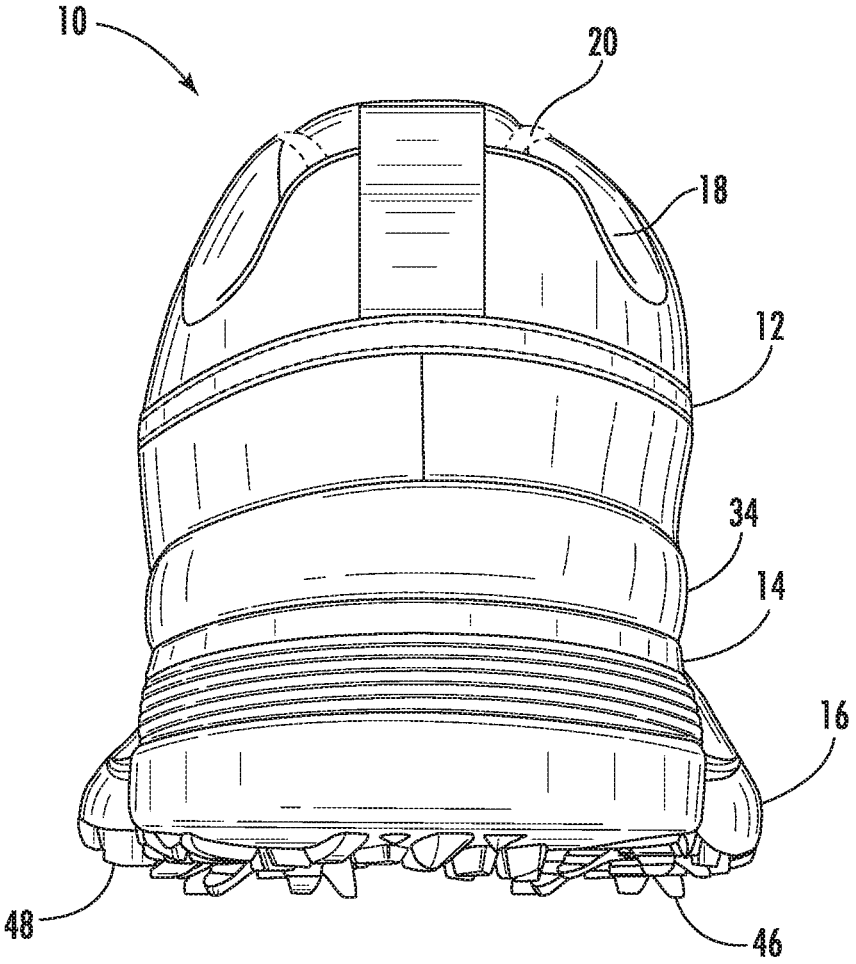
FIG. 8 is a rear view thereof.
Figure 9:
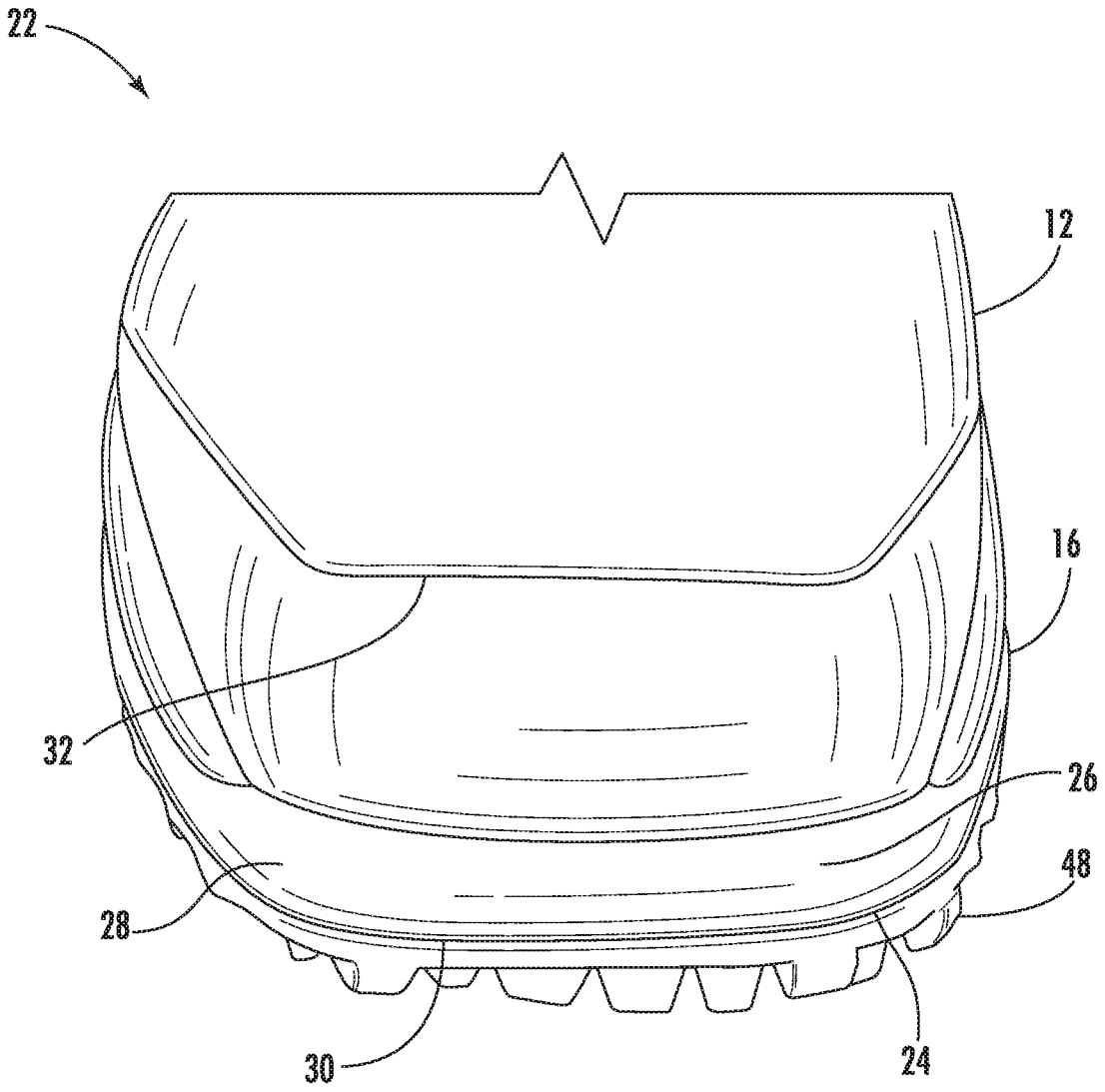
FIG. 9 is an enlarged partial front view thereof.

As can be seen particularly in FIGS. 1, 3 and 5, the outsole 16 pitches rearwardly at the front end of the shoe 10. As such, the outer radius 24 of the outsole 16 is forward of the inner radius 26 and the portion between the outer and inner radii 24, 26, herein referred to as a front band 28, is visible from above by the wearer. As see in FIG. 9, the front band 28 may include indicia such as a brand name or a logo, or symbols, patterns, color variations, etc. In the illustrated embodiment, the front band 28 includes text 30 arranged in a generally linear fashion. Herein, in the terms "linear" and "line" are used to refer generally to the trace of a moving point and are intended to include lines and linear features of all types, straight, curved, a combination thereof, etc. The toe area 22 of the shoe 10 includes a linear feature 32 disposed on the upper 12. The linear feature 32 extends substantially transversely on the shoe for about 40 mm to about 60 mm. In one embodiment, the linear feature 32 extends for about 50 mm. As illustrated, the linear feature 32 is delimited by a seam of the upper 16. Alternatively, the linear feature 32 can be formed by a printed line, graphic, text, symbol, other indicia, hot melt lines, etc.

The outer radius 24, the inner radius 26, the indicia on the front band 28, and the linear feature 32 create a series of corresponding lines which are visible from above the shoe 10 by the wearer. These corresponding lines are herein collectively referred to as "linear elements". Despite their differences in radius length and shape, these linear elements give the appearance of being generally, colinear, concentric and/or somewhat parallel. The series of linear elements creates multiple parallel visual cues which increases the Vernier Acuity of the wearer when observing their feet. Vernier Acuity in visual psychophysics refers to the process of identifying offset in parallel lines. Thresholds of Vernier Acuity are on the order of detecting approximately 10-30 seconds of arc. This threshold is approximately 10 times better than any other type of acuity task such as recognition acuity. Vernier Acuity is measured by finding the just discriminable offset for an edge separating fields of different luminance. The contrast of this stimulus is specified by the formula:

$$c=(Lstim-Lsur)(Lstim+Lsur),$$

where Lstim is the luminance of the stimulus and Lsur is that of the surrounding background.

Vernier thresholds are about 4-5 sec of arc for contrasts.

The series of linear elements at the toe area 22 of the shoe 10 create a directional hyperacuity which can be used by the wearer to assist in aiming toward the target and in aligning their body with respect to the golf ball in preparation for the golf swing. Proper body positioning (i.e., alignment) during the golf swing is a critical fundamental task which enables proper movement of the body and hence the golf club throughout the swing, thus promoting effective contact with and accurate directing of the ball. Alignment in golf is typically taught by envisioning railroad tracks extending from the ball to the target, where the ball and the clubhead are on the outer track with the clubhead aimed to the target, and the feet of the golfer are positioned on the inner track and are generally arranged square thereto.

The series of linear features on the toe area 22 of the shoe 10 serve to activate the brain's hyperacuity and assist the golfer in properly setting their feet and effectively positioning and aiming their body and the clubhead relative to the intended target. That is, the series of transverse linear elements at the toe area 22 of the shoe 10 are spatially positioned to activate the Vernier Acuity of the wearer thus enabling the brain of the wearer to perceive the straightness of aim better. This allows the wearer to more accurately and more consistently align their feet, body, and clubhead along the "railroad tracks" mentioned above. In one exemplary non-limiting embodiment, the spatial positioning of the various linear elements has been found to be optimized where the distance D1 from the outer radius 24 to the inner radius 26 is about 5 mm to about 8 mm (see, FIG. 6), the distance D2 from the inner radius 26 to the linear feature 32 is about 12 mm to about 16 mm, the front band 28 has a height H from a side proximate to the outer radius 24 to an opposite side proximate to the inner radius 26 of about 4 mm to about 6 mm, and the front band 28 has a surface width W (see, FIG. 1) of about 7 mm 10 mm.

The golf shoe 10 incorporates a series of multiple visual cues 24, 26, 28, 30, 32 in the form of defined contrasting substantially colinear or concentric edges and indicia systematically and spatially arranged on the front portion of the toe area of the shoe which serve to activate the brain's hyperacuity and assist the golfer in properly positioning their body in relationship to the intended target. The edges or parallel lines can be created by forming the sole area of the toe region to have any combination of the following: an outer most horizontal edge; an inner horizontal edge, an edge created by the intersection of the sole and the upper material in the toe area; placement of indicia onto or embossed into the sole; a horizontal edge or line delimited by the upper material of the toe region of the shoe; edges or lines created by coatings or materials with varying degrees of thickness; the use of texture to create edges or lines; embossment on the upper material to form a horizontal edge or line, and the use of colors to create contrast to form an edge or line.

The various linear elements arranged at the toe area 22 of the shoe 10 have been described herein by way of example as being formed of inner and outer edges of the outsole 16, text 30, and a linear seam feature 32. The linear elements of course could be formed by any means suitable for creating transverse linear or generally linear effects on at the toe area 22 or elsewhere on the shoe 10 which would contribute to Vernier hyperacuity. For example, the linear features could be formed by any combination or modification of color contrast, printing indicia, sewing techniques, intersection of different textiles or components, shoe laces, style lines, textures, contrasting material thickness, embossing, shoe laces, hot melt, and surface treatments.

Figure 10:
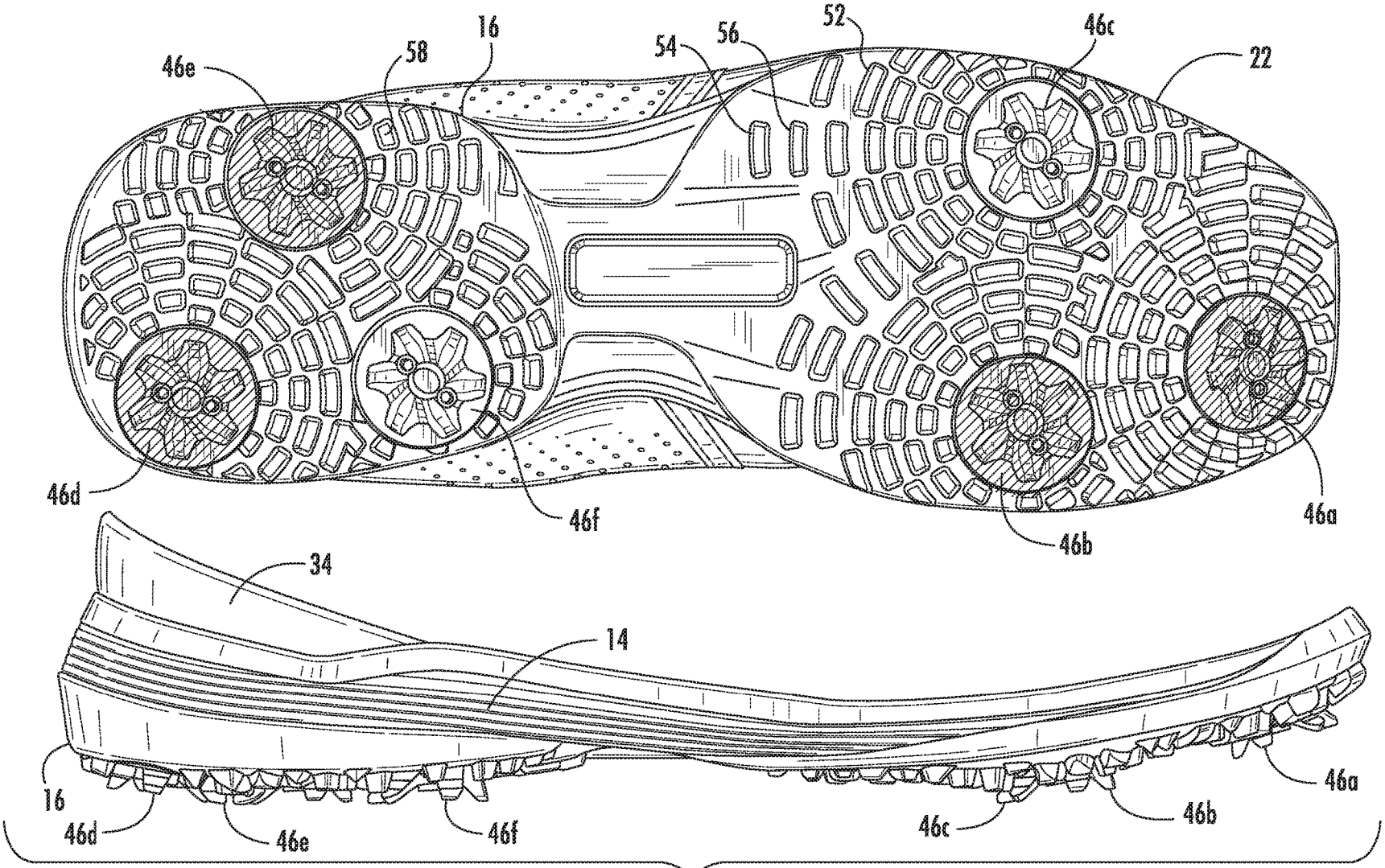
FIG. 10 is a bottom and side profile view of a midsole and outsole of the shoe.
Figure 11:
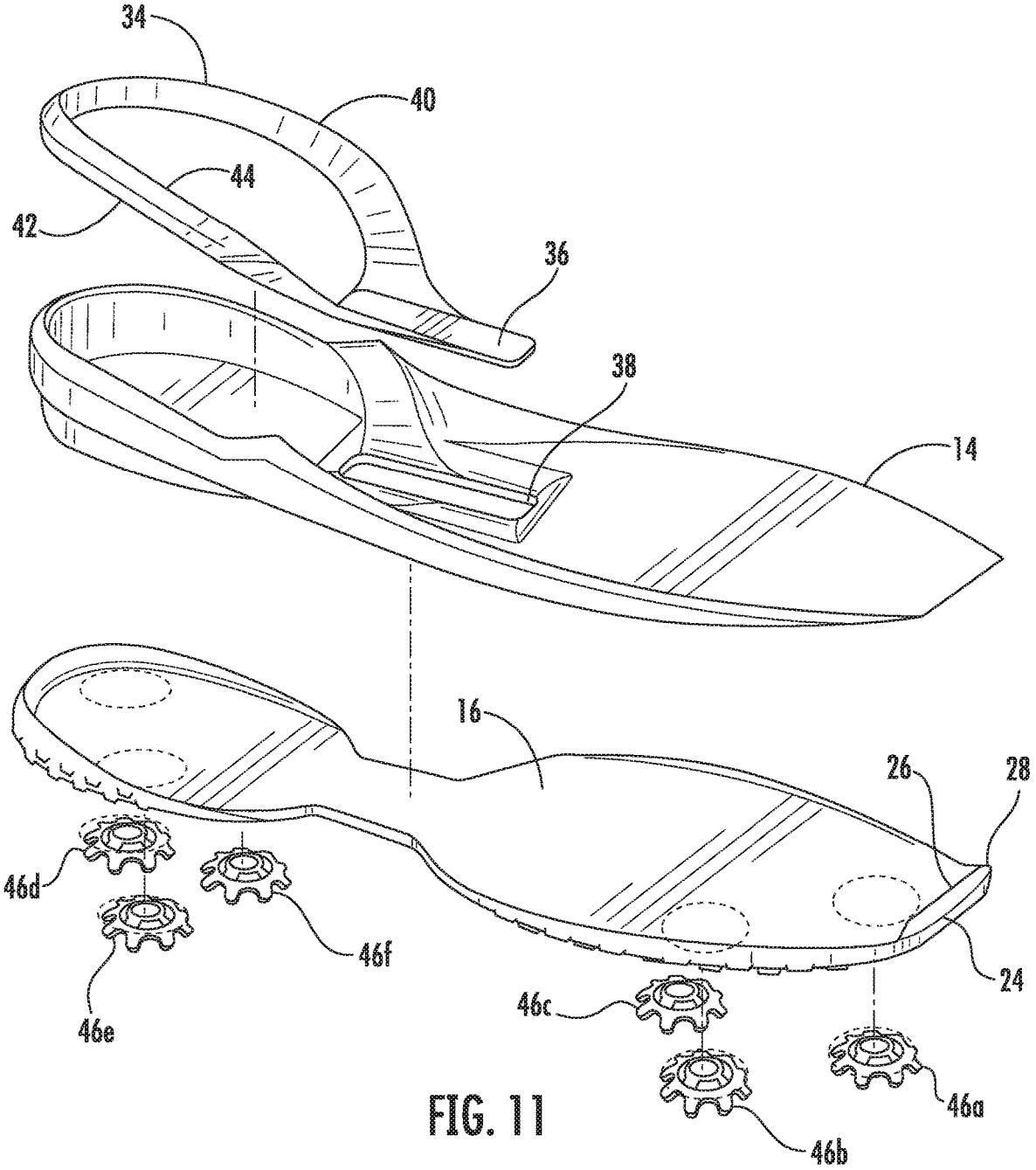
FIG. 11 is a partial exploded view of the shoe showing the midsole, the outsole, a plurality of cleats, and a heal stabilizer.

FIG. 10 contains a bottom view of the outsole 16 and a side view showing the midsole 14 disposed on the outsole 16 and a heel stabilizer 34 disposed atop the midsole 14. FIG. 11 provides an exploded view showing the outsole 16, midsole 14, heel stabilizer 34, and cleats 46. The heel stabilizer 34 includes a midfoot shank 36 configured to be received and retained within a receptacle portion 38 of the midsole 14. The midfoot shank 36 can be affixed to the midsole and/or to the underlying outsole 16. The heel stabilizer 34 further includes a heel band 40 which extends from the midfoot shank 36 to surround the heel of the wearer. One side of the heel band 40 runs down into the arch area of the shoe 10 where it connects with the midfoot shank 36. The opposite side of the heel band 40 traverses an outer lateral portion of the shoe 10 to the junction with the midfoot shank 36. A lower edge 42 of the heel band 40 is affixed to the midsole 14 and an opposite upper edge 44 of the heel band 40 is affixed to the upper 12 (see, e.g., FIG. 6). In one embodiment, the heel stabilizer 34 is a one piece, monolithic structure where the midfoot shank 36 passes through the receptacle portion 38 of the midsole 14 and is fixed to the outsole 16 of the shoe 10. The heel stabilizer 34 and the midfoot shank 36 comprise a molded external counter, heel stabilizer that creates a platform which centers and supports the wearers foot. This enhances fit and performance as well as aids in avoiding possible instability related injury. The heel band 40 and midfoot shank 36 essentially delimit an asymmetrical ring that adds more control to the lateral heel and more flexibility in the arch area. In this exemplary embodiment, the heel stabilizer 34 is a rigid piece of plastic which is configured to center the foot of the wearer in the shoe 10 providing better comfort, range of motion, and helps to prevent roll over injury. In alternate embodiments, the heel stabilizer 34 can be formed of a carbon or polymer material, or any material generally sufficient to center the foot within the shoe 10 and to provide stability to the foot as described herein.

FIGS. 10 and 11 also show the placement of a plurality of cleats 46 on a bottom of the outsole 16. In the illustrated embodiment, the shoe 10 includes six cleats 46*a*, 46*b*, 46*c*, 46*d*, 46*e*, and 46*f* The cleats 46*a-c* are positioned in a front forefoot area of the outsole 16, while the cleats 46*d-f* are positioned in a rear heal area of the outsole 16. The cleats 46 are strategically positioned directly under areas of the foot where the most pressure is applied during wearing, and especially during the golf swing. The cleats 46*a*, 46*b*, 46*d*, and 46*e* are disposed in areas that are subjected to maximum pressure during the golf swing. These cleats 46*a*, 46*b*, 46*d*, and 46*e* and or their surrounding areas may be identified by the color red or by certain other color or colors, and/or text, graphic, indicia, etc., in order to designate the areas of maximum pressure. The cleats 46*a*, 46*b*, 46*d*, and 46*e* may also be provided with added compression or may include a different shape or size than the remaining cleats 46 in order to withstand the maximum pressure and to provide the wearer with enhanced stability and traction.

In the illustrated example, the cleat 46*a* is disposed in the toe area 22 of the outsole 16 of the shoe 10 and is arranged so as to be proximate to a big toe of the wearer of the shoe 10. The cleat 46*b* is arranged in a forefoot area of the outsole 16 and is disposed so as to be proximate to the first ray, i.e., the bones of the big toe, when the shoe 10 is worn. The cleats 46*d* and 46*e* are both disposed in a heel area of the outsole 16, the cleat 46*d* being arranged on the medial side of the shoe 10 toward the rear extent of the heel area and being generally aligned with the cleat 46*b*. The cleat 46*e* is disposed on the lateral side of the shoe 10, forward relative to the cleat 46*d*. In general, the cleats 46 are positioned as close to the outer edges (medial and lateral) of the outsole 16 in order to increase overall stability of the shoe 10.

The outsole 16 further includes a series of outwardly projecting lugs 48 arranged relative to the cleats 46. In the illustrated example, the lugs 48 are arcuate shaped segments arranged so as to trace concentric circles extending around each of the several cleats 46. See, e.g., 4, 10, and 12. The lugs 48 include an inner arc wall 50, an outer arc wall 52, opposing side walls 54, 56, and a ground contacting surface 58. The walls, 50, 52, 54, and 56 may be arranged to extend generally perpendicularly from the outsole 16, the ground contacting surface 58 being arranged orthogonally thereto and generally parallel with the surface of the outsole 16. In an alternate embodiment, one or more of the walls 50, 52, 54, 56 may extend from the outsole 16 non-perpendicularly, i.e., at an angle greater than or less than ninety degrees relative to the surface of the outsole 16. Similarly, the ground contacting surface 58 may be arranged at an angle relative to the surface of the outsole 16 so as not to be parallel thereto. The various lugs 48 may uniformly extend a similar distance from the surface of the outsole 16. Alternatively, the distance that the lugs 48 extend from the sole may vary across the bottom of the shoe 10. That is, lug height can vary across the length of the outsole 16, lug height being the distance a particular lug extends from the bottom of the shoe 10. On a particular lug 48, the size of the walls 50, 52, 54, 56 may be equal or may vary. From one lug 48 to the next lug 48, the size of the respective walls 50, 52, 54, 56 and the angles thereof relative to the outsole 16 may be equal or may vary. As illustrated herein, the lugs 48 have varying heights relative to the surface of the outsole 16 in order to provide better traction on uneven surfaces. The lugs 48 generally extend from the surface of the outsole 16 a distance of about 1.5 mm to about 3.0 mm. In one embodiment, lug height is a function of weight distribution and ground contact. Lug height is the greatest where weight and ground contact are maximized.

The configuration of the lugs 48 as arc segments arranged in concentric circles around the several cleats 46, facilitate proper movement of the feet of the wearer through the golf swing. There is a degree of rotational movement of the feet during the golf swing. The circularly arranged lugs 48 allow for rotational pivoting of the feet while still providing for traction and stability. This is particularly advantageous in the follow-through of the golf swing, i.e., the portion of the swing that occurs after the golf ball is contacted. During this part of the golf swing, the hips and upper body of the golfer turn from a position generally facing the lying position of the standing ball to a position facing the target. To facilitate this nearly ninety-degree rotation of the hips and upper body, the forward and particularly the rear foot of the golfer rotates also in the direction of the target. Inhibiting this rotation could result in strain and/or injury in the ankles and knees. The circular pattern of the lugs 48 allow for and encourage this rotation of the golfer's feet, but yet provide needed traction and stability.

Figure 12:
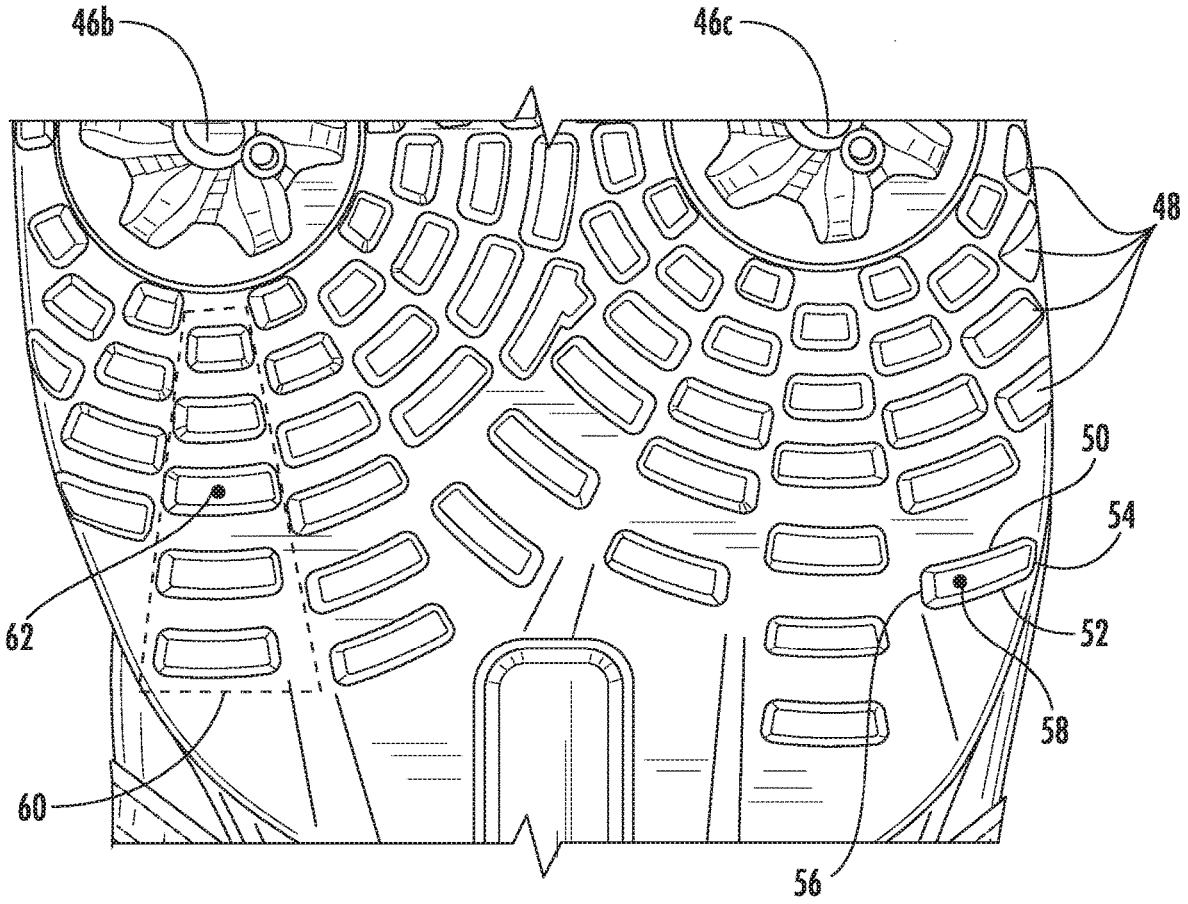
FIG. 12 is a partial enlarged view of a bottom of the outsole of the shoe.

The lugs 48 may also be viewed as being arranged in rays extending radially from the cleats 46. An exemplary ray 60 can be seen in FIG. 12 and comprises a series of lugs 48 arranged as arcuately shaped segments where the distance between the side walls 54, 56 of the lugs 48 increases as the distance from the respective cleat 46 increases. In one exemplary embodiment, the distance that the lugs 48 extend from the surface of the outsole 16 also increases with the distance of the lugs 48 from the respective cleat 46 to an inflection point 62 after which, the radially outward lugs 48 decrease in height relative to the surface of the outsole 16.

As discussed, the cleats 46*a*, 46*b*, 46*d*, and 46*e* bear the highest pressure and strain during the golf swing due to downward and rotational forces imparted thereupon. In one exemplary embodiment, the shoe 10 further includes drop-in segments 64 disposed in the outsole 16 and/or midsole 14 proximate to one or more of the cleats 46*a*, 46*b*, 46*d*, and 46*e*. See, FIGS. 13-14. The drop-in segments 64 are formed of a material that is softer and perhaps more compressible than a material used to form the outsole 16. As such, the drop-in segments 64 are formed of any material sufficient to absorb at least some of the downward pressure applied to the cleats 46*a*, 46*b*, 46*d*, and 46*e*. In one example, the drop-in segments 64 are formed of urethane and are about 2-4 mm in height and about 35 mm in diameter.

The material forming the drop-in segments 64 is also configured to allow for a pivoting of the shoe during the golf swing when at least some of the cleats 46*a*, 46*b*, 46*d*, and 46*e* are grounded. When the golfer executes a swing, the rotational pressure is imparted upon the cleats 46*a*, 46*b*, 46*d*, and 46*e* during the back swing, i.e., as the golfer initially recoils the golf club in preparation for striking the golf ball. During this movement, the cleats 46*a*, 46*b*, 46*d*, and 46*e* are, for the most part, fixed in and gripping the turf. The softer material forming the drop-in segments 64 will allow a slight pivot of the golf shoe 10 and the foot during this movement of the golfer and generate a torque relative to the grounded cleats 46*a*, 46*b*, 46*d*, and 46*e*. At the top of the golf swing, when the golf club is at the furthest apex of its rearward travel, this torque force is at its maximum and is released as the golfer begins the movement of the clubhead toward the ball, thus advantageously increasing forward momentum and hence clubhead speed. The rotational pivot provided by the drop-in segments 64 also serves to reduce stress and strain in the ankles and knees of the golfer.

Figure 13:
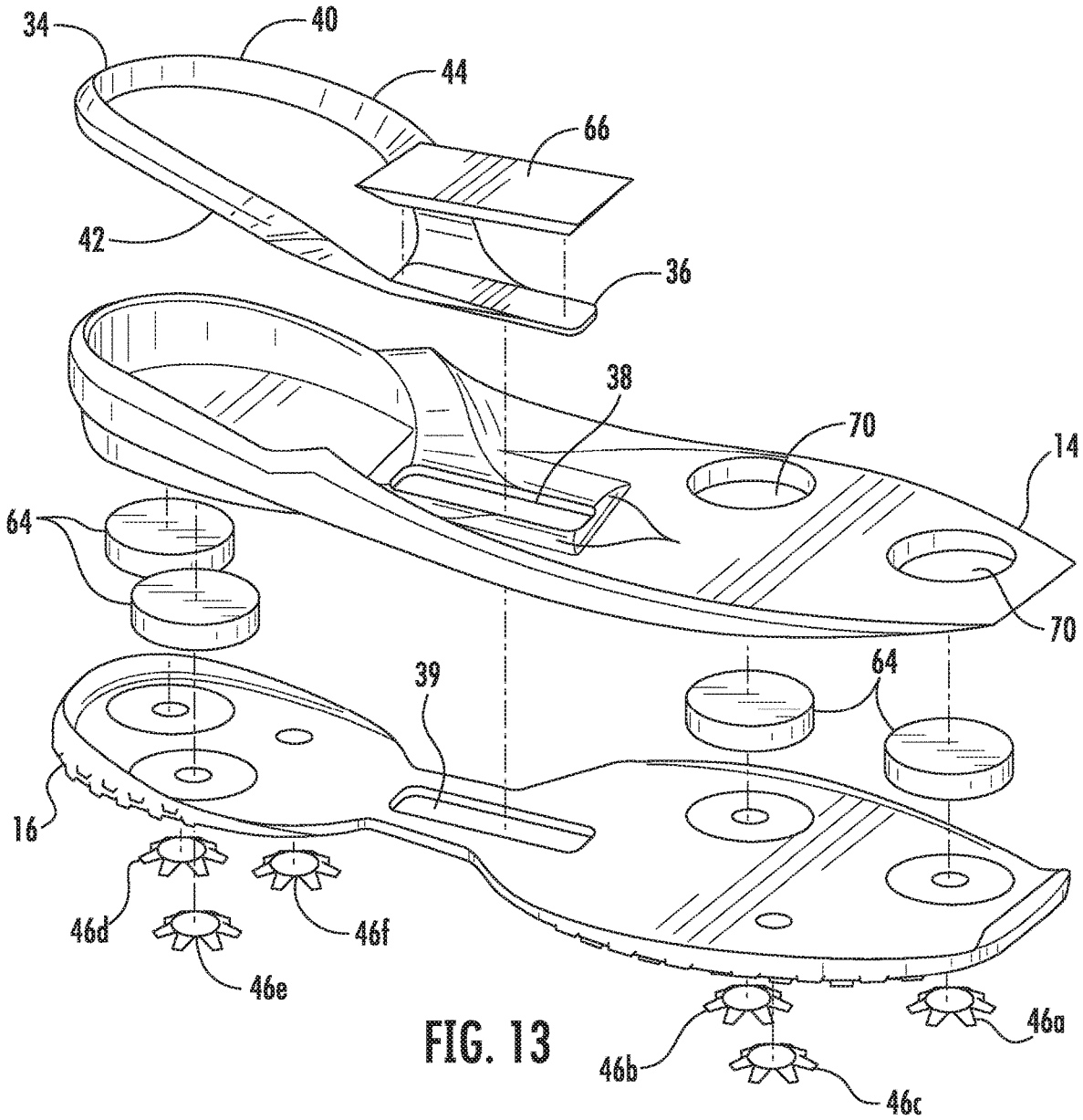
FIG. 13 is a partial exploded view of the shoe showing the midsole, the outsole, the plurality of cleats, the heal stabilizer, and a plurality of drop-in segments.

In the embodiment illustrated in FIG. 13, the midfoot shank 36 of the heel stabilizer 34 extends through the receptacle portion 38 of the midsole 14 and through a corresponding receptacle 39 of the outsole 16. The midfoot shank 36 is secured to the midsole 14 and outsole 16 at the receptacles 38 and 39, respectively, with adhesive, welding, bonding, or other technique sufficient to secure the heel stabilizer 34 to the midsole 14 and outsole 16. An underside of the midfoot shank 36 is visible through the receptacle 39 at the underside of the outsole 16. See, FIG. 14. This visible area of the midfoot shank 36 may include surface features 41 such as indicia, text, graphics, colors, contours, etc., or any combination thereof. Reverting to FIG. 13, the shoe may further comprise a midfoot drop-in segment 66 shaped and configured to cover the midfoot shank 36 of the heel stabilizer 34 and to be received and retained in a contoured area 68 formed around the receptacle 38. The midfoot drop-in segment 66 has a rectilinear shape when viewed in plan from above and has an underside that is shaped to correspond with the contoured area 68 in order to facilitate disposition therein. The midfoot drop-in segment 66 provides comfort and additional support in the arch area of the shoe 10.

Figure 14:
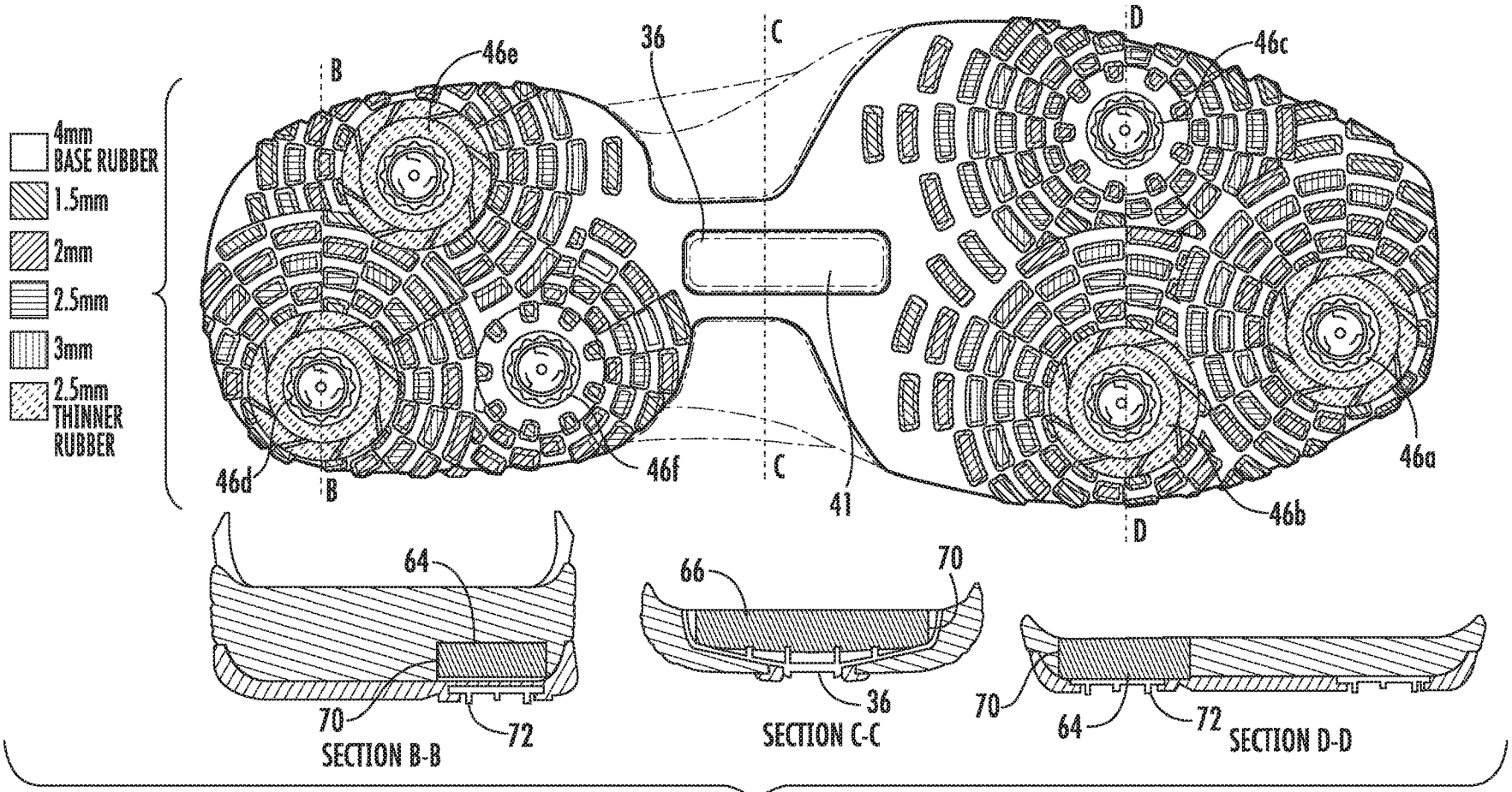
FIG. 14 shows a bottom view of the outsole of the shoe and corresponding sectional views.

FIG. 14 shows exemplary heights of the lugs 48 relative to the surface of the outsole 16. As indicated, lug height varies from about 1.5 mm to about 3 mm. As explained with reference to FIG. 12, lug height increases with increasing radial distance away from the cleats 46 until an inflection point 62 where a maximum height of 3 mm is reached, after which lug height decreases to 2 mm and 1.5 mm. FIG. 14 also shows several sectional views of the midsole 14 and outsole 16 illustrating the location of the drop in segments 64 and 66. As seen in this and the previous Figure, the midsole 14 includes openings 70 for receiving the drop-in segments 64, 66. The drop-in segments 64 which are aligned with the cleats 46 are disposed immediately above a corresponding anchor 72 for the respective cleat 46. The drop-in segment may be connected directly to the anchor 72 or may be connected to an underside of the outsole 16 to which the anchor is connected. The midfoot drop-in section 66 is disposed above and is in contact with the midfoot shank 36 of the heel stabilizer 34.

The obliquely shaped toe area 22 of the shoe 10 is wider than traditional golf shoes in order to provide additional space for the toe region of the foot of the wearer. Traditional golf shoes have a narrow toe area in which the width dramatically decreases in a direction toward the front of the shoe. This construction angles the toes of a wearer (particularly the big toe) toward a centerline of the shoe, thus reducing the overall space occupied by the toe region of the wearer hence decreasing stability and restricting motion of the foot and shoe during the golf swing. The first ray of the foot, i.e., the bones of the big toe, is known to carry 40% of body weight during a static stance and it's proper functioning is critical for effective ambulation. Traditional golf shoes constrict the first ray and interfere with its important functionality.

In one embodiment, the toe area 22 of the shoe 10 has a width that is about 10-15% wider than that of a traditional golf shoe. Preferably, the toe area of the shoe 10 is about 12.5% wider than a traditional shoe. For example, the toe area 22 of the shoe 10 may have a width of four and a half inches in a men's shoe, U.S. size 10-11, while a similar sized traditional golf shoe has a width in the toe/forefoot area of only four inches. In order to maintain the geometry of the shoe 10, the forefoot is tapered and an oblique, less rounded toe region 22 is formed. The added room in the forefoot region allows the foot to operate with full range of motion during the golf swing and provides a larger base for contacting the ground thus achieving greater stability and ground connection. The expanded forefoot region of the shoe 10 allows the toes of the wearer to extend straight in the forward direction and are not compressed or directed toward the centerline as in traditional golf shoes. This encourages proper functioning of the first ray, while increasing balance and stability and permitting a degree of motion to the foot within the shoe 10 during the golf swing.

Figure 4:
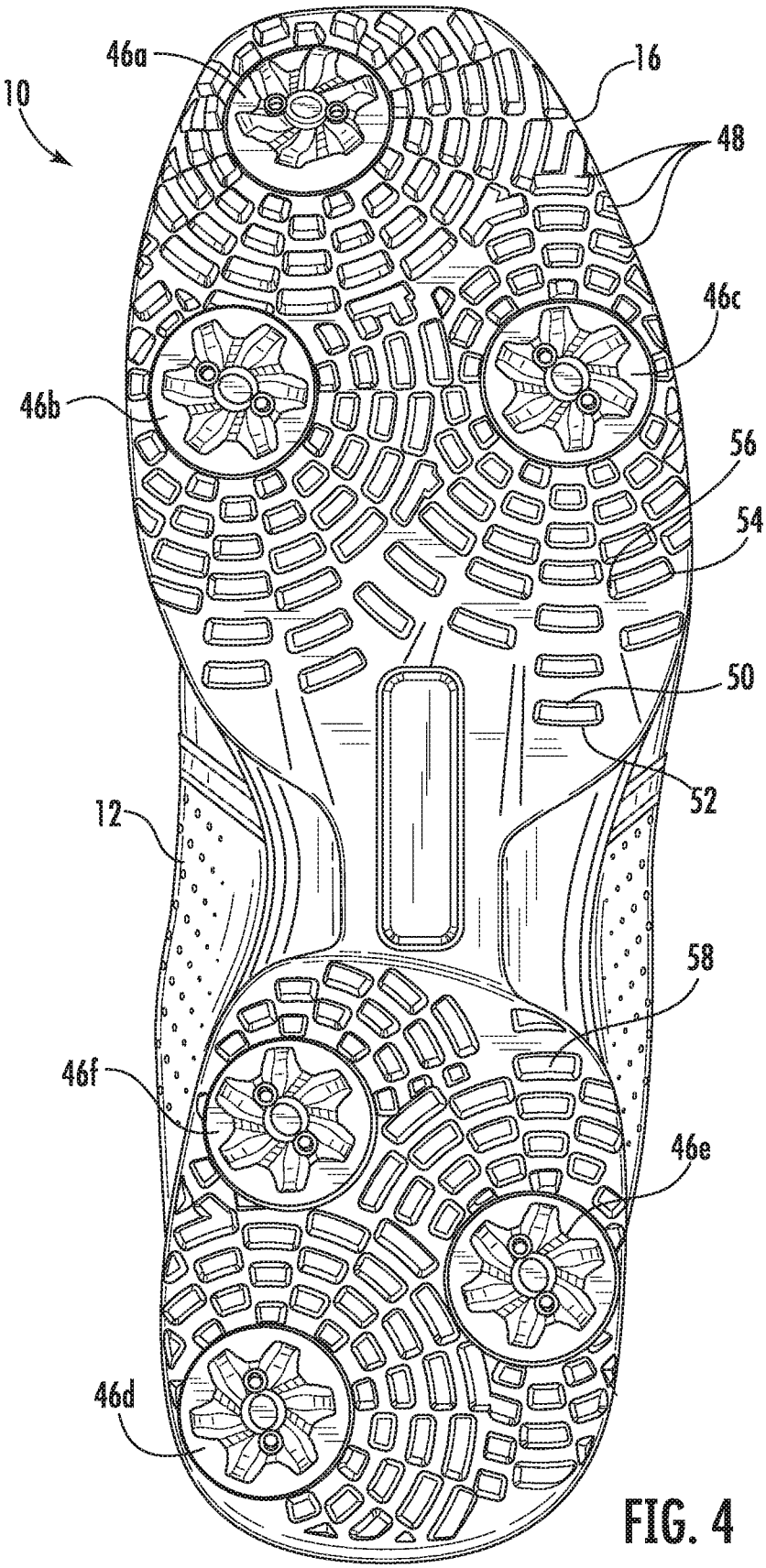
FIG. 4 is another bottom view thereof.

In one embodiment, the internal volume of the toe region 22 remains proportionally consistent from an area where a ball of the foot of the wearer is disposed when the shoe 10 is worn to an area where ends of the toes of the foot of the wearer are disposed. For example, as illustrated in FIG. 4, the ball of the foot area is arranged proximate to the cleat 46*b* and the end of the toes area is disposed proximate to the cleat 46*a*. That is, the internal volume of the toe region 22 from a rearward side of the cleat 46*b* to a forward side of the cleat 46*a* remains proportionally consistent. This allows the forefoot to act naturally as the weight of the wearer transfers from the heel to the toes and allows the foot to help distribute the weight evenly as the toe region 22 is not tapered and hence does not restrict the front of the foot to an uncomfortable alignment.

The forward edge of the toe region 22 of the shoe 10 has been expanded from an area of a big toe of the wearer toward an area that houses the remaining smaller toes. This allows more volume and freedom of movement during walking and play, and particularly during the golf swing. This forward edge of the toe region 22 is generally delimited by the inner radius 26 of the outsole 16, as can be seen for example in FIGS. 1, 3, 5, etc. The volume increase is tangential to a first ray of the foot of the wearer, going from a medial side to a lateral side of the interior of the toe region 22 of the shoe 10.

A golf shoe is provided herein with a toe region at the front of the shoe having an oblique appearance. Many advantages of this construction have been discussed herein. Using an oblique, nearly square toe as a start point for the shoe facilitates the symmetrical look of the shoe as it is viewed from the front moving toward the heel. This construction allows for the base of the shoe to be expanded under the ball of the foot for greater stability and balance while still preserving an attractive and balance appearance.

Various embodiments of the present invention are described herein with reference to the related drawings. Alternative embodiments can be devised without departing from the scope of this invention. It is noted that various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship.

The term "exemplary" is used herein to mean "serving as an example, instance, or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. Terms such as "connected to", "affixed to", etc., can include both an indirect "connection" and a direct "connection."

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The invention claimed is:

1. A shoe for golf, comprising:

an upper, a midsole, and an outsole arranged to form an enclosure adapted to receive a foot of a wearer; and a toe area disposed at a front of the shoe and adapted to house toes of the wearer;

wherein the toe area has an oblique shape delimited by an outer radius of the outsole of greater than zero;

wherein the shoe further comprises:

a plurality of cleats arranged on a bottom of the outsole; and lugs generally arranged in concentric circles about each of the plurality of cleats, wherein each lug is shaped as an arcuate segment and extends along the respective concentric circle;

wherein the lugs increase in arc length and height relative to the outsole in a direction radially away from the respective cleat up to an inflection point beyond which the height decreases.

2. The shoe of claim 1, wherein the outer radius is about 60 mm to about 80 mm.

3. The shoe of claim 2, wherein the outer radius is about 70 mm.

4. The shoe of claim 2, wherein the outsole includes an inner radius of about 55 mm to about 75 mm, wherein the inner radius is arranged radially inward of the outer radius, and wherein the inner and outer radii delimit a front band arranged to be visible from above by the wearer.

5. The shoe of claim 4, further comprising indicia disposed on the front band and extending in a direction generally colinear with at least one of the inner and outer radius.

6. The shoe of claim 4, further comprising a linear feature disposed on the upper rearward of the outer radius and the inner radius, wherein the linear feature extends in a direction generally colinear with at least one of the inner and outer radius.

7. The shoe of claim 6, wherein the outer radius, the inner radius, and the linear feature delimit a plurality of multiple generally collinear visual cues to activate a Vernier Acuity of the wearer when observing the shoe.

8. The shoe of claim 1, wherein the toe area has a width of about four and one-half inches to allow the toes of the wearer to extend straight during the golf swing and to allow the foot of the wearer to move during the golf swing, and wherein the toe area has a volume that is consistent from an area adjacent to a ball of the foot of the wearer to an area adjacent to ends of toes of the wearer.

9. The shoe of claim 1, further comprising a heal stabilizer having a heel band extending around a heel portion of the shoe connected at a midfoot area to a midfoot shank which is fixed to at least one of the midsole and the outsole, wherein the heel stabilizer is configured to center the foot of the wearer within the shoe to provide stability to the foot.

10. The shoe of claim 1, wherein the plurality of cleats comprises a first cleat disposed in the toe area of the shoe and arranged to generally align with a big toe of the wearer, a second cleat disposed in a forefoot area of the shoe and arranged to generally align with a first ray of the foot of the wearer, a third cleat disposed at a medial side of a heel area of the shoe proximate to a rearward extent of the shoe, and a fourth cleat disposed on a lateral side of the heel portion, forward of the third cleat.

11. The shoe of claim 1, further comprising a drop-in segment disposed in at least one of the midsole and the outsole proximate to one of the plurality of cleats and adapted to absorb pressure and permit a degree of rotation of the shoe relative to the cleat when the cleat is engaged in contact with the ground during a golf swing.

12. The shoe of claim 11, wherein the drop-in segment is formed of a urethane material and said drop-in segment is provided for each of the plurality of cleats.

13. A sole for a golf shoe, comprising:

a plurality of cleats arranged on a bottom of the outsole at areas that are subject to the highest forces during use of the shoe, the plurality of cleats comprising a first cleat disposed in the toe area of the shoe and arranged to generally align with a big toe of the wearer, a second cleat disposed in a forefoot area of the shoe and arranged to generally align with a first ray of the foot of the wearer, a third cleat disposed at a medial side of a heel area of the shoe proximate to a rearward extent of the shoe, and a fourth cleat disposed on a lateral side of the heel portion, forward of the third cleat; and lugs generally arranged in concentric circles about each of the plurality of cleats, where each lug is shaped as an arcuate segment and extends along the respective concentric circle wherein the lugs increase in arc length and height relative to the outsole in a direction radially away from the respective cleat up to an inflection point beyond which the height decreases.

* * * * *